United States Patent [19]

Altmix

[11] 4,406,730

[45] Sep. 27, 1983

[54] DRYWALL TAPE DISPENSER

[76] Inventor: James J. Altmix, 13124 Acres Green Dr., Littleton, Colo. 80124

[21] Appl. No.: 326,408

[22] Filed: Dec. 1, 1981

[51] Int. Cl.[3] ..... B32B 1/00

[52] U.S. Cl. ..... 156/574; 156/577; 156/579

[58] Field of Search ..... 156/523–526, 156/574–577, 579, 71; 24/3 A, 68 A, 68 AS

[56] References Cited

U.S. PATENT DOCUMENTS

| | | | |
|---|---|---|---|
| 1,044,190 | 11/1912 | Kohart | 156/526 |
| 1,196,796 | 9/1916 | MacLaurin | 156/123 |
| 2,187,809 | 1/1940 | Rabuaggo | 24/68 AS |
| 2,328,571 | 9/1943 | Meyer | 216/33 |
| 3,116,195 | 12/1963 | Lathrop et al. | 156/575 |
| 3,575,771 | 4/1971 | Padgett | 156/523 |
| 3,871,940 | 3/1975 | Antonioni | 156/353 |
| 3,880,701 | 4/1975 | Moree | 156/577 X |
| 4,080,240 | 3/1978 | Dysart | 156/575 |
| 4,086,121 | 4/1978 | Ames | 156/526 |
| 4,116,748 | 9/1978 | Lass | 156/526 |
| 4,196,028 | 4/1980 | Mills et al. | 156/71 |

*Primary Examiner*—David A. Simmons
*Attorney, Agent, or Firm*—John E. Reilly

[57] ABSTRACT

A drywall tape dispenser of the hand-held portable type has a tape supply roll journaled between spaced apart sidewalls for forward advancement of a drywall tape along a guide path established between a pair of pinch rolls and upwardly along a pressure roller at the leading end of the dispenser. The dispenser is sufficiently compact and lightweight that it can be held in one hand and includes a hand operable lever to operate a tape cutter to sever the tape at the end of each tape application; and a corner roller is pivotally mounted for movement into a position along the path of travel of the tape for selective application of tape along the corners between adjoining drywall sections.

14 Claims, 4 Drawing Figures

DRYWALL TAPE DISPENSER

This invention relates to dispensing tools, and is more particularly directed to a hand-operated device for applying drywall tape to seam adjacent wallboard panels together, both along flat surfaces and corners.

BACKGROUND AND FIELD OF THE INVENTION

The application of drywall or wallboard panels to wall studs or ceiling joists is a common practice in the construction field. After such panels are nailed or otherwise secured to the building frame, it is desirable to seam them together along adjoining edges, both along flat wall surfaces and corners, in order to lend a smooth and continuous appearance to the finished wall.

Various types of tapes and taping methods have been employed in the past. In a commonly-used taping device, an adhesive compound is applied to paper tape as it is dispensed through pressure rollers onto the panels to be joined. Representative of this approach are U.S. Pat. No. 4,080,240 to Dysart and U.S. Pat. No. 4,196,028 to Mills et al. Both disclose a manually-operated device connected to a pressurized "mud" or adhesive supply line. As tape is drawn through the rollers from a continuous roll, it is automatically coated with adhesive and may then be applied to the wall joints and pressed into place with rollers. Dysart discloses an extendable bevelled roller for smoothing tape into corners; the corner roller of Mills et al is not retractable, but rather may be rigidly fixed or spring-biased in front of the main rollers.

Despite improvements in operation and manipulability, known taping tools remain unwieldy and cumbersome, particularly due to the necessity of having an attached mud supply line. This problem has been partially alleviated by recent improvements to the tape itself, wherein adhesive is pre-applied to a tape made of mesh or other open material. A line to the mud source is no longer required, and the apparatus for applying the mud to the tape is eliminated from the body of the tool, thus reducing tool weight and enhancing portability. Nonetheless, the taping devices of the prior art are not well suited for use with the newer tapes: they are unnecessarily heavy, have many moving parts, and require two-handed operation both in applying tape to the wall and in cutting the tape from the roll. The tape dispensing tool of the present invention proposes to fulfill the need for a lightweight, easily operated tape dispenser specifically suited for use with adhesive mesh drywall tapes.

SUMMARY OF INVENTION

The preferred form of taping tool of the present invention generally comprises an open frame between which are journaled a pair of cooperating feed rollers through which the tape is threaded from a supply roll housed within the frame, and a wide, flat pressure roller is journaled in the frame downstream of the feed rollers for pressing the tape onto flat wall surfaces. A second generally V-shaped or convex roller is extendable from an out-of-the-way position within the frame into an operative position forwardly of the main roller, and is fixedly secured in the forward position by a pin or limit stop. The convex roller permits smooth and even application of the tape in corners and at wall-ceiling junctions.

A lever-operated cutting blade disposed between the feed rollers and the main roller allows the tool operator to sever the tape at any desired point; further, the cut end of the tape remains extended from between the feed rollers and thus the operator may continue taping without the interruptions necessitated by re-threading after each cut. A hand strap is interchangeably threaded through slots on either side of the frame for left-hand or right-hand operation and is adjustable in length. The strap affords the operator a more secure hold on the tool, and facilitates efficient and convenient operation with one hand if necessary.

It is therefore an object of the present invention to provide for a novel and improved portable taping tool specifically adapted for use in applying tape to drywall, sheet rock and other wall board materials.

It is another object of the present invention to provide for a novel and improved taping tool that is compact, lightweight and easily manipulated, has few moving parts, and is relatively simple to operate; and further wherein the tool can be supported in one hand and the tape applied along flat surfaces or corners and severed at the desired point in one continuous operation.

It is an additional object of the present invention to provide a tape dispenser which is readily conformable for applying tape to adjacent flat wall panels or to corners while assuring secure and even adhesion of the tape to the wallboard.

It is still a further object of the present invention to provide a taping tool with a retractable corner roller which may be extended into a position forwardly of a main roller to facilitate smooth and even application of mesh tape to the corners formed between adjoining drywall panels.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF PREFERRED EMBODIMENT

Figure 1:
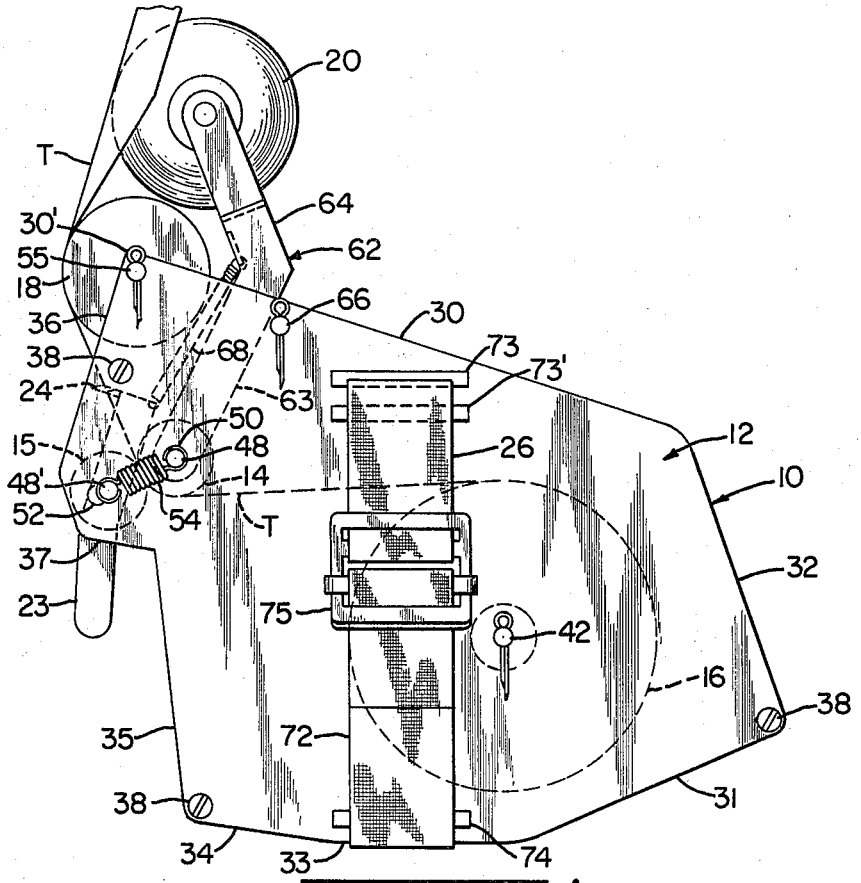
FIG. 1 is a side view in elevation of a preferred form of tape dispenser in accordance with the present invention.
Figure 2:
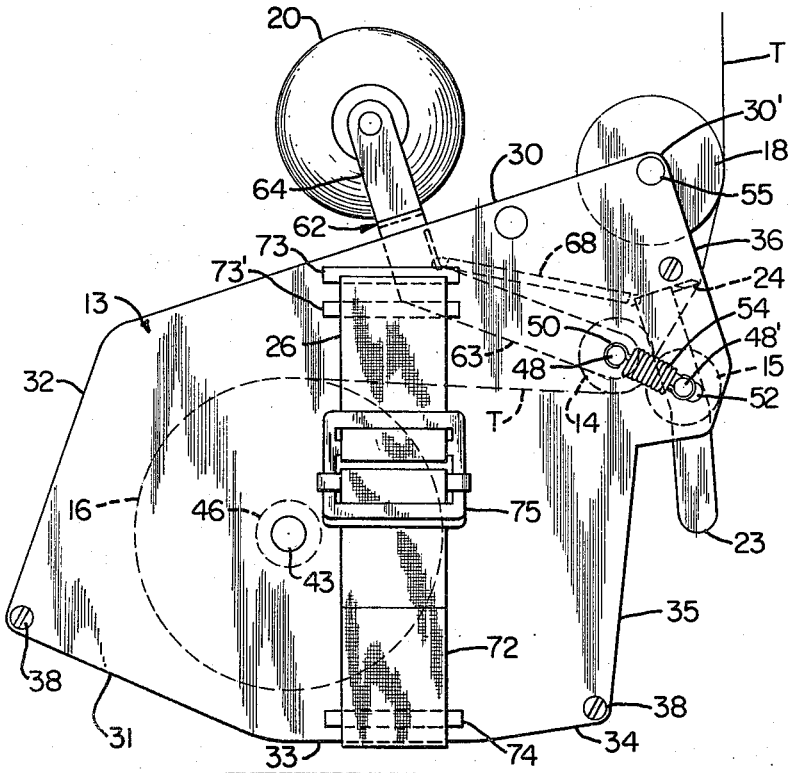
FIG. 2 is an elevational view of the opposite side of the tape dispenser illustrated in FIG. 1, with the corner roller in the retracted position.

Referring in more detail to the drawings, there is illustrated in FIGS. 1 to 4 a preferred form of tape dispenser which is broadly comprised of an open frame 10 having flat sidewalls 12 and 13 rigidly interconnected together in spaced parallel relation to one another. A pair of guide or pinch rolls 14 and 15 are mounted for rotation between the sidewalls and through which a tape T is threaded or advanced from a supply roll 16 journaled between the sidewalls. A flat pressure roller 18 is journaled between the sidewalls downstream of the guide rollers for advancement of the tape across a pressure roller 18 from the rolls 14 and 15. In addition, a second generally V-shaped or convex roller 20 is movable from an out of the way position within the frame into an operative position extending forwardly or downstream of the pressure roll 18 and can be releasably fixed in its operative position for the purpose of applying the tape along corners between walls or between wall-ceiling junctions. Tape cutter means 22 is pivotally carried by the frame and includes a hand operated lever 23 for actuation of a cutter blade 24 into engagement with the tape in its path of travel between the guide rolls 14 and 15 and the pressure roll 18. A hand strap 26 can be interchangeably secured to either of the sidewalls 12 or 13 in a manner to be described for either left-hand or right-hand grasping of the dispenser by the operator in advancing the tool along adjoining drywall surfaces.

An important feature of the preferred form of tape dispenser is the construction and arrangement of the entire dispenser assembly so as to be extremely compact and lightweight to the extent that it can be held and operated with one hand while leaving the other hand free to aid in positioning the tape at the start of each seaming operation as well as to guide the device along the designed path. To this end, the flat sidewalls 12 and 13 may be of a lightweight sheet metal material, each correspondingly formed with upper and lower, forwardly divergent edges 30 and 31 which extend forwardly from a common rearward or trailing edge 32 with the lower edge verging into a horizontal edge portion 33, the latter curving upwardly at 34 into a forwardly and upwardly inclined leading edge 35. In turn, the upper edge 30 terminates in a sharp corner 30' at its forward end and at its intersection with a downwardly and slightly forwardly inclined leading edge 36. The forwardly inclined leading edge 36 terminates at its lower end in a forwardly directed, horizontal edge 37 which projects forwardly from the upper end of the forwardly inclined surface 35. The sidewalls are rigidly interconnected by suitable fasteners, such as, cap screws 38 which are inserted through aligned openings around the edges of the sidewalls 12 and 13 into threaded openings at the opposite ends of spacer sleeves 39, all as best seen from FIG. 3. If desired, the sidewalls may be further rigidified or reinforced by the use of braces, not shown, exending between inner facing surfaces of the sidewalls 12 and 13 or by other suitable means. In connected relation, it will be noted that the sidewalls 12 and 13 are in the form of flat plates which define a main frame or open housing with a forward extension or projection as defined by the forward end of the divergent edge 30, inclined forward edges 36 and forwardly projecting horizontal edges 37 along the upper leading end of the frame 10.

The tape supply roll 16 is journaled somewhat centrally within the main body of the frame on a common shaft 42 which has opposite ends projecting through aligned openings in the sidewalls, one end 43 of the shaft being enlarged and the opposite end 44 provided with a transverse bore for insertion of a suitable fastener, such as, a cotter pin 45 to releasably retain the supply roll in place between the sidewalls 12 and 13. The supply roll 16 is supported on a suitable holder 46 disposed in surrounding relation to the shaft 42 in order to facilitate the replacement of the supply roll 16 once the tape supply is depleted simply by removal of the cotter pin 45 and withdrawal of the shaft from the holder so that the holder can be removed along with the depleted supply roll and a fresh supply roll replaced.

Preferably the tape T is threaded off of the upper surface of the supply roll in a forward horizontal direction to advance through the guide path established between the cooperating guide rolls 14 and 15. The guide rolls 14 and 15 are mounted on central shafts 48 and 48', respectively, and are correspondingly made up of straight cylindrical rollers each dimensioned to be of a length slightly less than the width or spacing between the sidewalls. The rolls 14 and 15 are of a corresponding diameter which is considerably smaller than the diameter of the main pressure roll 18 and are mounted relatively near the lower end of the forward extension of the open frame 10 so as to define a forwardly and upwardly angled guidepath for the tape T toward the upper pressure roll 18. For this purpose, the shaft 48 for the roll 14 is journaled in aligned circular openings 50 so that the feed roll 14 is free to rotate but is not shiftable with respect to the feed roll 15. However, the shaft 48' for the feed roll 15 is disposed in aligned, angularly directed elongated slots 52 which are inclined in a rearward and upward direction away from the lower end of the forward projection toward the aligned openings 50 for the feed roll 14. Tension springs 54 are arranged for extension from opposite ends of the shaft 48 toward opposite ends of the shaft 48' so as to yieldingly urge the forwardmost feed roll 15 in a direction causing its surface to bear against the surface of the feed roll 14.

The main pressure roll 18 is similarly a straight cylindrical roller mounted on a shaft 55 which is journaled in aligned openings in the sidewalls 12 and 13 contiguous to the upper corner 30' such that the outer surface of the roller is for the most part disposed externally of the frame and, most importantly, engages the tape T in forwardly spaced relation to the leading edge 36 of the frame.

Figure 3:
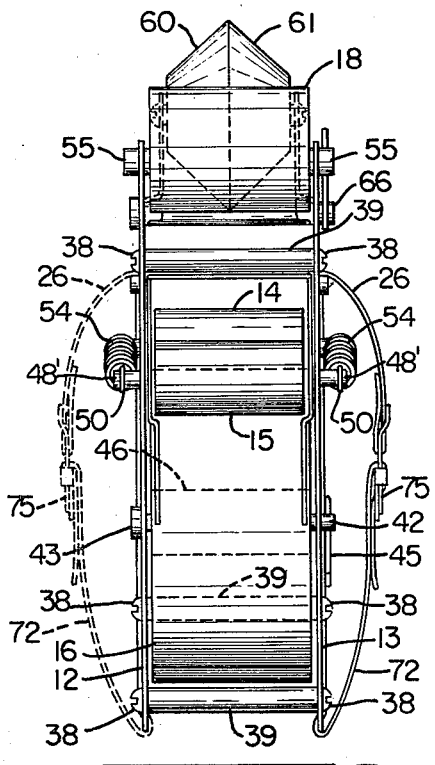
FIG. 3 is a front view in elevation of the preferred form of tape dispenser.

A second pressure roller 20 has an outer convex surface for the purpose of applying tape to corners between adjoining wall portions or wall and ceiling edges. As illustrated in FIG. 3 the corner roller 20 has external tape engaging surfaces 60 and 61 of generally V-shaped configuration and specifically wherein the included angle between the oppositely directed and inclined surfaces 60 and 61 is 90 degrees so as to conform to the angle between adjoining corner edges of a pair of drywall panels. Preferably, the corner roller 20 is journaled between the free distal ends of a pair of spaced arms 62 which are pivotally mounted on opposite ends of the shaft 48 for the feed roller 14. Preferably each arm includes a lower arm portion 63 inclining upwardly and somewhat rearwardly from its pivotal connection to the shaft 48 behind the pressure roll 18, and an upper arm portion 64 inclining upwardly and forwardly from the lower arm portion 63 when the roller is in its operative or working position as illustrated in full in FIGS. 1 and 4.

It should be noted that the pressure roller 20 is supported in its forwardly disposed operative position by means of a limit stop or pin 66 inserted through aligned openings adjacent to the upper edges 30 of the sidewalls 12 and 13 and which pin may be releasably held in place in the same manner as the shaft 42 for the supply roll 16 and therefore will not be described in detail.

Figure 4:
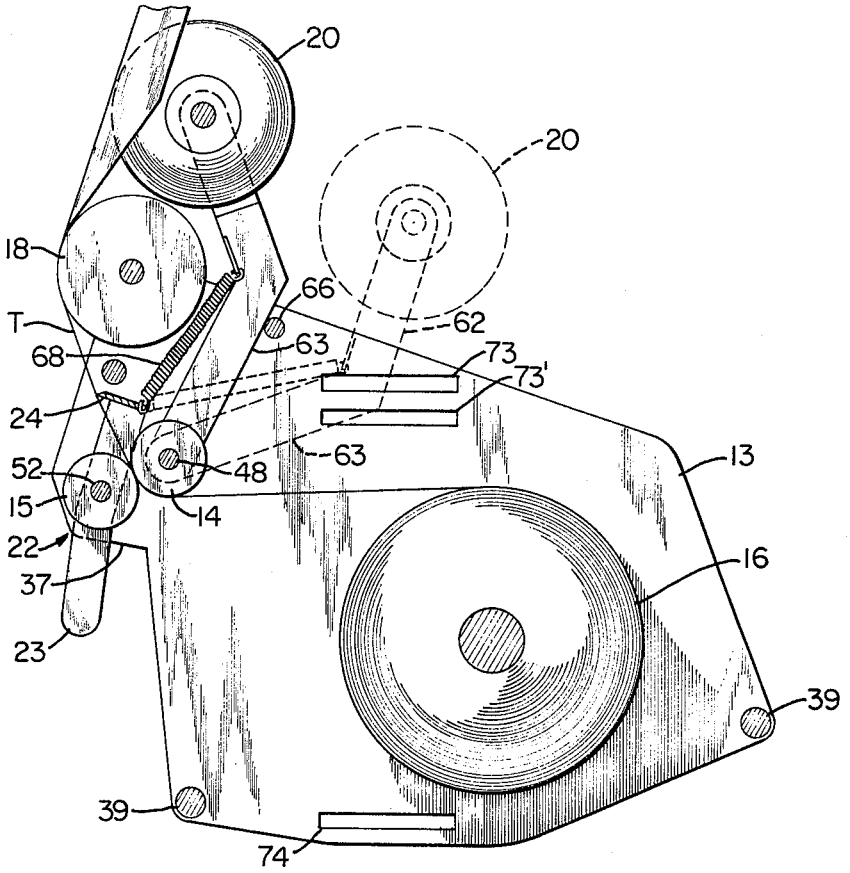
FIG. 4 is a view partially in section of the preferred form of tape dispenser illustrated in FIGS. 1 to 3 and further illustrating the movement of one of the pressure rollers between an operative and inoperative position.

In the preferred form of tape dispenser, the tape cutter means 22 is located such that the hand operated lever 23 is pivotally carried at opposite ends of the shaft 52 for the lower roll 15 along the inner wall surfaces of the sidewalls 12 and 13 with the cutter blade 24 having its cutter edge angled somewhat and facing in a forward direction at the upper free end of the lever 23. The lower end of the lever 23 projects downwardly beyond the horizontal edge 37 of the forward extension so that it is readily accessible for the operator to squeeze or pivot rearwardly with the fingers causing the cutter blade 24 to advance forwardly across the path of movement of the tape T intermediately between rolls 14 and 15 and the main pressure roll 18. A return spring 68 is arranged for extension between a transverse brace which extends between the lower ends of the corner roll support arm 62 and trailing edge of the cutter blade 24, the spring 68 mounted under compression so as to normally retain the cutter blade in its retracted position as illustrated in FIG. 4. However, when the lower end of the lever 23 is squeezed rearwardly sufficient clearance is afforded between the lever and inclined edge 35 to cause the cutter blade 24 to advance forwardly across the path of travel of the tape and to completely sever the tape at that point.

As previously noted, the preferred form of tape dispenser is so constructed and arranged as to faciliate grasping and operating in one hand. To this end, the hand strap 26 is preferably in the form of a continuous length of flexible webbing as designated at 72 which is inserted through upper and lower slots 73 and 74, respectively, in one of the sidewalls 12 and 13. Free ends of the webbing 72 are adjustably secured together by a suitable buckle 75 so that the effective opening size of the strap may be adjusted to permit insertion of one of the hands through the strap with the lever 23 being within reach of one or more of the fingers. In order that the strap may be secured externally of the sidewall, a double slot includes spaced parallel slots 73 and 73' which are arranged at the upper end of each sidewall so that the strap can be looped through the double slots and returned along the outside of the sidewall. Similarly, the lower end of the strap may be looped around the lower edge 33 of each sidewall and back through the slot 74 to return along the outside of the sidewall. Corresponding slots are provided on the opposite sidewall 13 so that the strap 26 may be secured to either sidewall depending upon whether the operator is left or right handed.

In practice, the tape T is advanced from the supply roll forwardly in a somewhat horizontal direction then upwardly between the pinchrolls 14 and 15 and across the forwardmost surface of the pressure roll 18. Assuming that the tape is to be used in seaming flat adjoining wall surfaces, the corner roller 20 is permitted to remain in the out of the way position as illustrated in dotted form in FIG. 4. The tape T is preferably of the mesh adhesive type and specifically wherein the necessary adhesive is incorporated along one surface of the tape. One commercially available form of mesh adhesive or pressure sensitive tape is that manufactured and sold by Perma Glass Mesh Corp. of Dover, Ohio and which is supplied in roll form. When the tape T is drawn off of the supply roll and advanced between the pinch rolls upwardly and past the pressure roll 18 it will have its adhesive surface facing outwardly or away from the pressure roll so as to be exposed for direct contact with the adjoining surfaces of the drywall. Thus the tape may be advanced with one hand as the dispenser is held in the other hand until the leading end of the tape is directly in front of the pressure roll 18. Starting at the upper adjoining edges of the wall surfaces, the tape is self-adherent to the wall surfaces as the dispenser is advanced downwardly along the adjoining edges and by virtue of the self-adherent characteristic of the tape will be automatically drawn off the supply roll, forwardly through the pinch rolls and across the front surface of the pressure roll onto the drywall surfaces. Little in the way of guidance is required by the other hand as the dispenser is advanced downwardly to form a seam along the adjoining edges. When the dispenser reaches its lowermost end limit of travel, the trigger or lever 23 is engaged by the fingers and retracted so as to force the cutter blade 24 forwardly to advance across the path of travel of the tape for complete severance or cutting of the tape. Once severed, the severed end of the tape on the dispenser will remain in position extending somewhat beyond the pinchrolls 14 and 15 so that it can be easily grasped and brought into position on the pressure roll to initiate the next seaming operation.

When it is desired to apply the tape along corner adjoining edges between drywall surfaces, the corner roller 20 is raised into its operative position and held there by insertion of the limit stop 66. In this mode of use, the tape is drawn upwardly beyond the pressure roll over the forwardmost surface of the corner roll as illustrated in FIG. 1 as a preliminary to initiating the application of tape to the corner. In a manner corresponding with that described in reference to the flat pressure roll 18, the tape engaging surfaces 60 and 61 of the corner roller will bend the tape to form a seam along the adjoining edges of the drywall surfaces at the corner. Again at the lower terminal edge of the corner the lever 23 is retracted to force the cutting edge of the blade 24 into engagement with the tape to sever it at that point; and once severed the edge of the tape may be manually pressed against the corner surfaces of the drywall to complete the seam.

It will be evident from the foregoing that an extremely compact, simplified and lightweight dispenser for drywall tape has been devised which will greatly facilitate the application of tape both to flat and corner surfaces in a dependable manner. The dispenser may be supported and guided with one hand, using the same hand to actuate the tape cutter at the completion of each seaming operation. The open frame construction of the cutter not only reduces its weight and size but greatly simplifies reloading of a new supply roll as well as periodic cleaning of the pinch rolls and other parts and elements making up the assembly. Still further, the mounting of the cutter blade and corner roller in cooperation with one another on adjoining shafts of the pinch rolls eliminates separate mounting elements while at the same time enabling utilization of the corner roll support arms as an anchoring device for the return springs extending to the cutter blade. Moreover when the corner roller is in use, the main pressure roll 18 will aid in maintaining proper alignment and in flattening the tape for extension across the corner roll preliminary to its application to the drywall surfaces without in any way interfering with the operation of the corner roll. In this relation, the corner roll is preferably composed of a rubber or rubber-like material, such as, a neoprene rubber with a hardness on the order of 40 durometers so as to possess sufficient resiliency or "give" that it will readily conform to slight differences in the precise angle formed between the adjoining wall sections.

It is to be understood that while a preferred form of invention has been described various modifications and changes may be made in the construction and arrangement of elements without departing from the spirit and scope thereof as defined by the appended claims.

I claim:

1. In a tape applicator device wherein an open frame is provided with spaced apart sidewalls, a tape supply roll journaled between said sidewalls and a first pressure roller is journaled between said sidewalls adjacent to one edge of said open frame, the improvement comprising:

guide roll means journaled in said open frame between said tape supply roll and pressure roll for guiding tape from said supply roll across a surface of said pressure roll externally of said open frame;

tape cutter means pivotally mounted on said open frame including a hand operable lever projecting externally of said open frame and a cutter blade pivotal in response to actuation of said lever into the path of travel of said tape whereby said tape cutter means is operative to sever said tape at a predetermined location; and a second pressure roller including means pivotally mounting said second pressure roller on said guide roll means for pivotal movement between a position away from the path of travel of said tape and a working position in the path of travel of said tape downstream of and in alignment with said first pressure roller.

2. In a tape applicator device according to claim 1, one of said sidewalls including a hand strap adjustably secured to one of said sidewalls.

3. In a tape applicator device according to claim 1, each of said sidewalls including means for externally connecting a hand strap thereto.

4. In a tape applicator device according to claim 1, said open frame including a relatively wide forwardly divergent frame portion within which said tape supply roll is mounted and a forwardly convergent extension of reduced width in relation to said frame portion within which said guide roll means and said first pressure roll are mounted.

5. In a tape applicator device according to claim 4, said guide roll means defined by a pair of pinch rollers journaled in spaced parallel relation to one another including means yieldingly urging one pinch roller into surface engagement with the other of said pinch rollers whereby to guide the advancement of said tape from said tape supply roll between said pinch rollers across the surface of said first pressure roll.

6. In a tape applicator device according to claim 5, said tape cutter means being pivotally mounted on a shaft for one of said pinch rollers such that said lever projects downwardly from said forward extension.

7. In a tape applicator device according to claim 6, said second pressure roller pivotally mounted on a shaft for said other of said pinch rollers for movement into a working position above said first pressure roller, and limit stop means releasably positioned in at least one of said sidewalls to support said second pressure roller in said working position.

8. A portable drywall tape dispenser comprising in combination:

an open frame having a pair of spaced sidewalls including a forwardly convergent extension at one end;

a tape supply roll journaled between said sidewalls;

a first pressure roller journaled in said forward extension;

guide roll means journaled within said open frame for guiding tape from said tape supply roll across said pressure roller externally of said forward extension;

tape cutter means mounted on said open frame including a hand operable lever projecting externally of said open frame and a cutter blade pivotal in response to actuation of said lever into the path of travel of said tape whereby said tape cutter means is operative to sever said tape at a predetermined location;

a second pressure roller having a convex tape-engaging surface, said second pressure roller including means pivotally mounting said second pressure roller for movement into engagement with said tape downstream of and in alignment with said first pressure roller; and a hand strap, each of said spaced sidewalls provided with securing means for interchangeable, adjustable connection of said hand strap externally of each said respective sidewall whereby to permit insertion of one hand within said strap by an operator so that the fingers of one hand are in a position to actuate said hand operable lever on said tape cutter means.

9. A portable drywall tape dispenser according to claim 8, said second pressure roller having V-shaped tape-engaging surfaces disposed at an angle of substantially 90 degrees to one another.

10. A portable drywall tape dispenser according to claim 9, said pivotal mounting means for said second pressure roller defined by a pair of pivotal support arms pivotal on said guide roll means for extension between said sidewalls behind said first pressure roller.

11. A portable drywall tape dispenser according to claim 8, said tape cutter means including a lever arm pivotally mounted on said guide roll means for advancement of said cutter blade into the path of movement of said tape from said guide roll means into said first pressure roller.

12. A portable drywall tape dispenser according to claim 11, said tape cutter means including a return spring extending between said lever arm and said pivotal mounting means for said second pressure roller yieldingly urging said cutter blade into a retracted position away from the path of movement of the tape between said guide roll means and said first pressure roller.

13. A portable drywall tape dispenser according to claim 11, said lever arm projecting downwardly from said forwardly convergent extension to terminate in a free end disposed externally of said open frame.

14. A portable drywall tape dispenser according to claim 8, said second pressure roller composed of a resilient material such that its tape-engaging surface will conform to different angles formed at the corners between adjoining wall sections.

* * * * *